US010151058B2

(12) United States Patent
Carpenter et al.

(10) Patent No.: US 10,151,058 B2
(45) **Date of Patent: *Dec. 11, 2018**

(54) AGITATOR ASSEMBLY WITH SCRUB BRUSH FOR A FABRIC TREATING APPLIANCE

(71) Applicant: WHIRLPOOL CORPORATION, Benton Harbor, MI (US)

(72) Inventors: Scott E. Carpenter, Wanatah, IN (US); Orrin P. Lorenz, Saint Joseph, MI (US); Joel A. Luckman, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/687,843

(22) Filed: Aug. 28, 2017

(65) Prior Publication Data

US 2018/0044841 A1 Feb. 15, 2018

Related U.S. Application Data

(63) Continuation of application No. 15/184,418, filed on Jun. 16, 2016, now Pat. No. 9,903,063.

(51) Int. Cl.

| | |
|---|---|
| ***D06F 39/02*** | (2006.01) |
| ***A46B 9/00*** | (2006.01) |
| ***A46B 11/00*** | (2006.01) |

(52) U.S. Cl.

CPC ..... *D06F 39/024* (2013.01); *A46B 9/005* (2013.01); *A46B 11/0062* (2013.01); *A46B 2200/3053* (2013.01)

(58) Field of Classification Search

None

See application file for complete search history.

(56) References Cited

U.S. PATENT DOCUMENTS

| | | | | |
|---|---|---|---|---|
| 3,053,066 | A | 9/1962 | Dodd | |
| 3,306,084 | A | 2/1967 | Bullock | |
| 4,154,069 | A | 5/1979 | Lipfert et al. | |
| 5,359,744 | A | 11/1994 | Kimball et al. | |
| 5,862,684 | A | 1/1999 | Park | |
| 6,334,343 | B1 | 1/2002 | Nwagbara | |
| 7,069,752 | B2 | 7/2006 | Clark et al. | |
| 8,684,614 | B2 * | 4/2014 | Chawla | B65D 47/42 215/390 |
| 8,828,920 | B2 | 9/2014 | Chawla et al. | |
| 9,115,452 | B2 | 8/2015 | Carr et al. | |
| 9,903,063 | B2 * | 2/2018 | Carpenter | D06F 39/024 |

FOREIGN PATENT DOCUMENTS

| | | | |
|---|---|---|---|
| BR | 202013026954 | U2 | 9/2015 |
| CA | 2434180 | A1 | 1/2004 |
| TW | 183448 | Y * | 5/1992 |
| TW | 183448 | Y | 5/1992 |

* cited by examiner

*Primary Examiner* — Michael E Barr
*Assistant Examiner* — Jason P Riggleman

(57) ABSTRACT

A fabric treating appliance having an agitator assembly comprising a base including at least one vane, and a tower extending upwardly from the base and terminating in an upper end having a recess. The agitator includes a cap having a top and a bottom that is removably mounted to the tower. A scrub brush is carried by the cap.

20 Claims, 4 Drawing Sheets

AGITATOR ASSEMBLY WITH SCRUB BRUSH FOR A FABRIC TREATING APPLIANCE

CROSS REFERENCE TO RELATED APPLICATIONS

This application is a continuation of U.S. patent application Ser. No. 15/184,418, filed Jun. 16, 2016, now U.S. Pat. No. 9,903,063, issued Feb. 27, 2018, which is hereby incorporated by reference in its entirety.

BACKGROUND OF THE INVENTION

Fabric treating appliances typically include a clothes mover, such as an agitator, that imparts mechanical energy to the laundry load, directly by contact between the laundry and the clothes mover or indirectly through movement of the water. In a vertical axis fabric treating appliance, such as a washing machine, an agitator can also serve as a centrifugally activated treating chemistry dispenser at a designated point during a programmed cycle of operation. Prior art agitators have a wash additive dispenser in the form of a dispensing cup, in an upper end of an agitator, capable of receiving, containing and centrifugally dispensing the wash additive liquid, generally a fabric softener. The cup is located within the upper end of the agitator and in which a fill opening is provided for filling the cup.

SUMMARY

One aspect of the present disclosure is an agitator assembly for a fabric treating appliance comprising a base, a tower extending upwardly from the base and terminating in an upper end having a recess, at least one vane located on the base, a cap having a top and a bottom, and a scrub brush having bristles extending from the bottom of the cap wherein the cap is removably mounted to the tower and when the cap is mounted to the tower, the bottom of the cap confronts the upper end of the tower and the scrub brush is located between the upper end and the bottom wherein at least a portion of the bristles extend downward and are received in the recess in the upper end of the tower.

Another aspect of the disclosure is an agitator assembly for a fabric treating appliance comprising a base, a tower extending upwardly from the base and terminating in an upper end having a recess, at least one vane located on the base, a cap having a top and a bottom, the cap being removably mounted to the tower, and a scrub brush having bristles extending from only the bottom of the cap wherein when the cap is mounted to the tower, the bottom of the cap confronts the upper end of the tower and the scrub brush is located between the upper end and the bottom wherein at least a portion of the bristles extend downward and are received in the recess in the upper end of the tower.

DESCRIPTION

Figure 1:
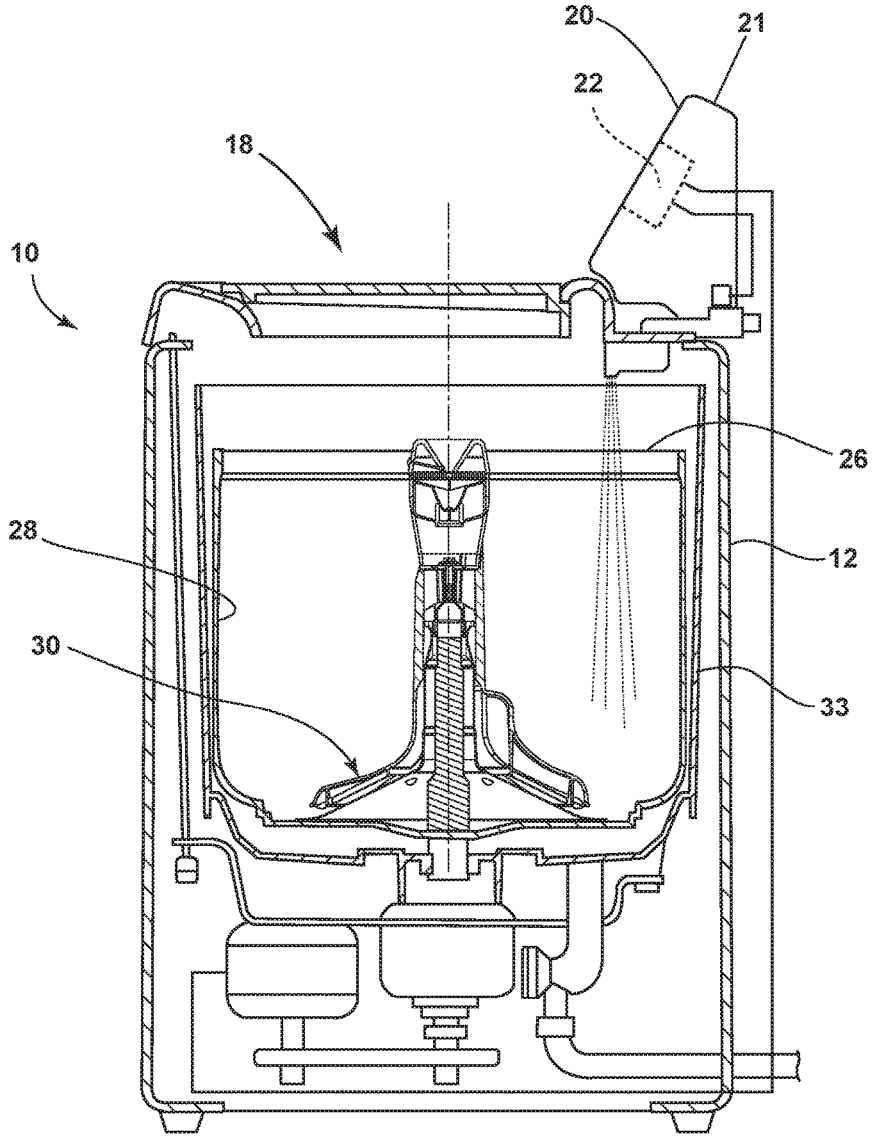
FIG. 1 is a schematic sectional view of a fabric treating appliance in the form of a washing machine having an agitator according to one embodiment of the invention.

FIG. 1 is a schematic view of a fabric treating appliance in the form of a vertical axis washing machine 10 according to an embodiment of the invention. The washing machine 10 of the illustrated embodiment can include a cabinet 12 for housing the operational parts of the machine, together with a hinged lid 18. A console 21 having control panel 20 which includes the operating controls 22 for the washer is illustrated on the upper, rear of the cabinet 12, but can be located elsewhere. Housed within the cabinet 12 is a wash tub 26, a basket or drum 28, and an agitator assembly 30. The tub 26 holds the wash liquid that is used in the operation of the washing machine 10. The basket or drum 28 holds the laundry during operation of the washing machine 10. The basket or drum 28 can be thought of as defining a treating chamber 33 in which the laundry is treated. However, the tub 26 can also be thought of as defining the treating chamber 33, too.

Figure 2:
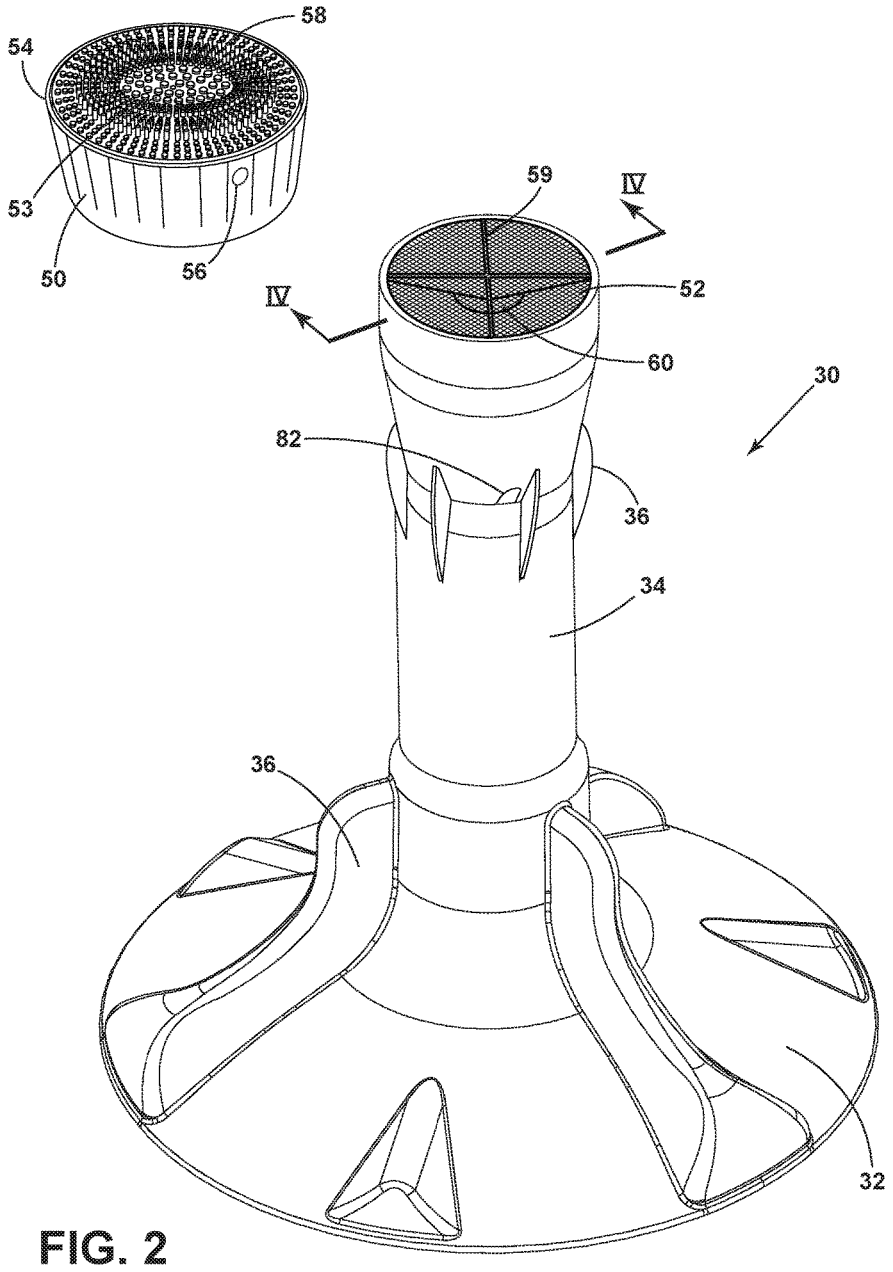
FIG. 2 is a perspective view of the agitator assembly of FIG. 1 with a cap removed from the agitator to reveal a scrub brush and a scrubbing surface.

Referring now to FIG. 2, which is a perspective view of an agitator assembly 30 from FIG. 1. The agitator assembly 30 includes a base 32 and a tower 34 extending upwardly from the base 32. One or more vanes 36 can be provided on one or both of the base 32 and tower 34.

The agitator assembly 30 has a removable cap 50, which is releaseably mounted to the upper portion of tower 34. The cap 50 can include scrub brush 54 at one end, and is threadably, snappably, or otherwise removably provided to the upper portion of agitator assembly 30. Cap 50, including scrub brush 54, can be provided to the upper portion of agitator assembly 30 such that the scrub brush 54 confronts the upper portion or the optional scrubbing surface 52 when the cap 50 is mounted. Alternatively, cap 50, including scrub brush 54, can be provided to the upper portion of agitator assembly 30 such that scrub brush 54 is hidden from view when cap 50 is mounted to the upper portion of agitator assembly 30.

Scrub brush 54 can be comprised of a plurality of bristles 58 formed in a variety of shapes and sizes or all of a singular shape and size, which define the bristles 58 for the scrub brush 54. The bristles 58 can be made of materials including but not limited to rubber, metal, silicon, nylon and other polymeric materials or mixtures thereof or any other material known to those skilled in the art to be safe and effective to use on fabrics and with treatment chemistries. For example, the bristles 58 can be made of Santoprene™ by Advanced Elastomer Systems, L.P., of Akron, Ohio. In this example, the center portion of scrub brush 54 is comprised of a plurality of bristles 58 that are longer and more flexible than the bristles 58 in the perimeter portion. The perimeter portion bristles 58 can be shorter, thicker, and tube-like when compared to the center portion bristles 58. The arrangement and type of the plurality of bristles 58 is illustrated by example only and the arrangement or design of the bristles 58 of scrub brush 54 are not limited by this example.

The upper portion of tower 34 of agitator assembly 30 terminates in an optional scrubbing surface 52. The scrubbing surface 52 can be perforated to provide for the passing of liquid through the scrubbing surface 52. The scrubbing surface 52 can be comprised of a perforated material such as mesh or polymeric materials or any surface that is conducive to allowing a liquid to pass through. The perforated material or mesh can be made of plastic, metal or any other suitable material. The scrubbing surface 52 can be supported by a frame 59 that is in spaced relationship to the terminal end of agitator assembly 30. The terminal end of agitator assembly 30 comprises a liquid passage 60 located beneath the scrubbing surface 52. When cap 50 is releasably mounted to the upper portion of agitator assembly 30, a liquid pass through opening 70 (FIG. 4) can be fluidly coupled to the liquid passage 60 through dispensing opening 53.

Figure 3:
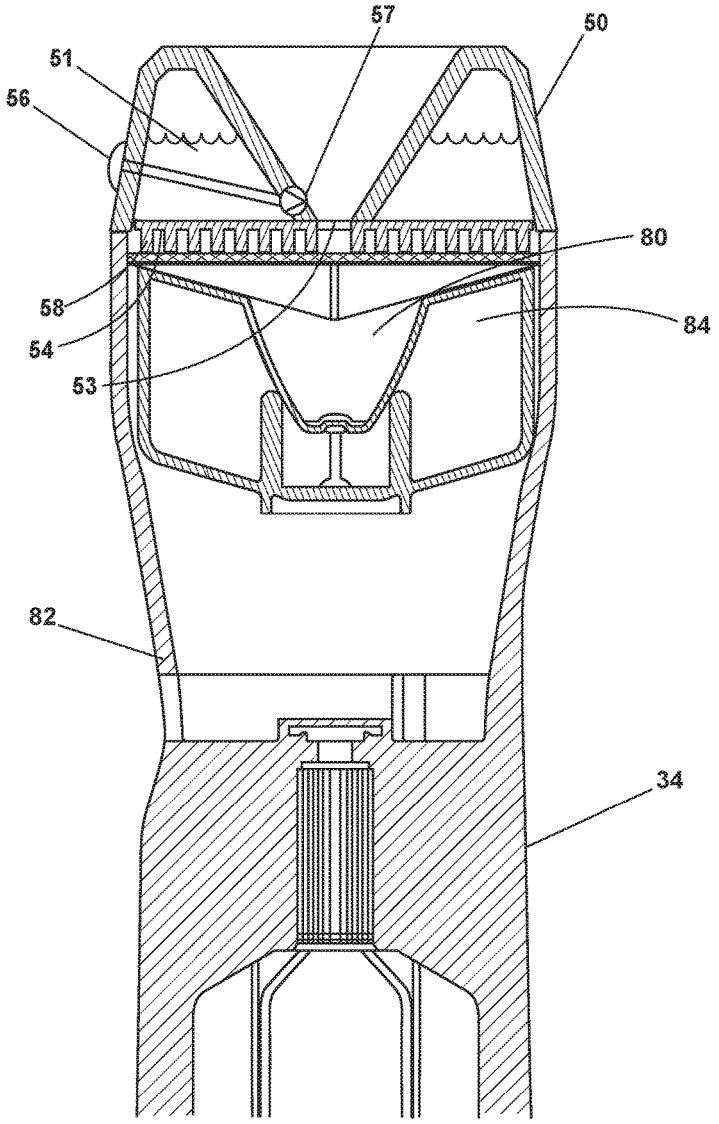
FIG. 3 is a schematic cross-sectional view of an agitator assembly of FIG. 2 with a cap mounted according to an embodiment of the invention.

FIG. 3 is a cross-sectional schematic view of the upper portion of the agitator assembly 30 with cap 50 mounted provided by example. The cap 50 can define a treating chemistry reservoir 51 fluidly coupled to a dispensing opening 53 in the scrub brush 54. The treating chemistry can be released by selectively actuating a valve 57 that opens and closes a dispensing opening in treating chemistry reservoir 51. A valve actuator button 56 can be accessible from the exterior of the cap 50 for the purposes of selectively opening and/or closing valve 57 fluidly coupled to a dispensing opening 53 of the scrub brush 54. Valve actuator button 56 can be disposed in any place on the exterior of the cap 50 so as to be accessible by the user.

Cap 50 is provided to the upper portion of agitator assembly 30 which further comprises a centrifugally actuated dispensing cup system. Any centrifugally actuated dispensing cup system can be used in any embodiment of the present invention. A dispensing cup 80 can be fluidly coupled to the liquid passage 60 provided in the upper portion of agitator assembly 30 beneath scrubbing surface 52. The dispensing cup 80 can be fluidly coupled to an additive dispensing reservoir 84 which can be fluidly coupled to one or more dispensing holes 82 provided in the center portion end of agitator assembly 30 in the base 32 and/or tower 34 at the base of the reservoir 84.

Figure 4:
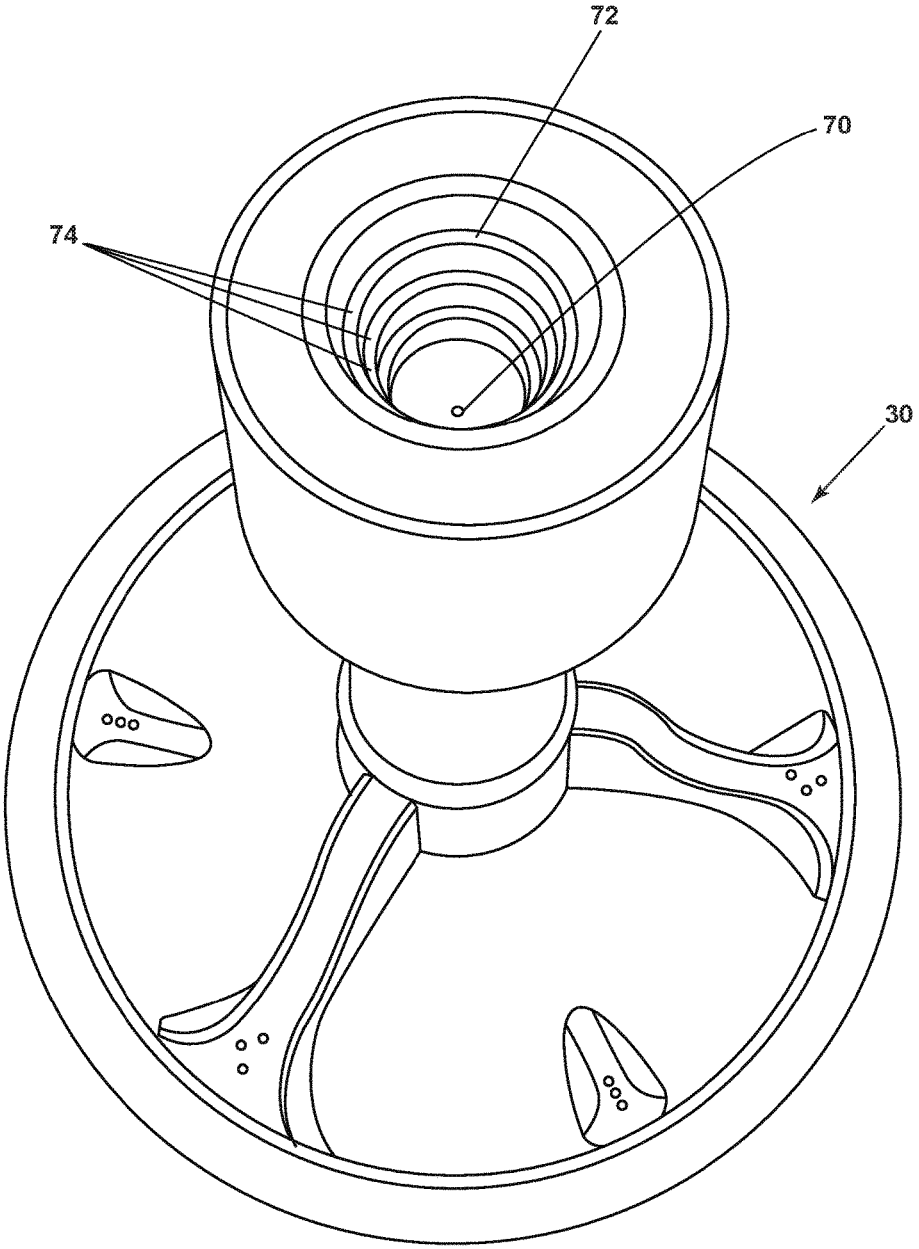
FIG. 4 is a perspective view of the agitator assembly with a cap mounted onto the assembly of FIG. 1 according to another embodiment of the invention.

In regards to FIG. 4, the cap 50 can additionally include a graduated dosage gauge 72, with the different dosage volumes indicated by stepped changes in the cross-sectional area of the gauge, which define rings at different heights to form varying graduated dosage levels 74. The dosage gauge 72 can be a snap-in addition to the cap 50 or integrated into the cap 50. Graduated dosage levels 74 can be specified to meet the requirements for optimal performance of the fabric treating appliance. The graduated dosage levels 74 can be designated for optimal performance of the treatment chemistry type. The terminal end of the graduated dosage gauge 72 can be provided with a liquid pass through opening 70 that is fluidly coupled via dispensing opening 53 to the liquid passage 60 located beneath the scrubbing surface 52.

Prior to initiation of a treatment cycle, a user may desire to pretreat a stain on a fabric. In one embodiment of the invention, the user can remove cap 50 from the agitator assembly 30. By pressing the button 56 on the exterior of cap 50 to actuate the valve, the user can dispense the stain treatment chemistry from the reservoir 51, through a dispensing opening 53, to the scrub brush 54. The user can place the fabric area to be treated on the scrubbing surface 52 and using any method of manual force, for example a scrubbing action, apply the treatment chemistry to the fabric in a manner appropriate for the type of fabric being treated. The center portion bristles 58 of scrub brush 54 can be finger-like and intended for use on delicate fabrics while still offering some mechanical scrubbing action. The perimeter portion bristles 58 of scrub brush 54 can be intended for use on more rugged fabrics or more difficult to remove stains that require more downward force and increased mechanical action. The tube shape of the perimeter portion bristles 58 can offer increased surface contact from the inside and outside of the tube structure and increased rigidity from increased wall thickness and reduction in height. The treatment chemistry applied then flows through the scrubbing surface 52, into the upper portion of the agitator assembly 30, through liquid passage 60 and into the dispensing cup 80, or alternatively, straight through into the treating chamber 33. The cap 50 can then be returned to the agitator assembly 30 upon completion of stain pretreatment.

A wash additive liquid can be poured into dispensing cup 80 via the liquid pass through opening 70 and dispensing opening 53 in cap 50 prior to the initiation of a treatment cycle. In another embodiment, a wash additive liquid can be poured into graduated dosage gauge 72, through liquid pass through opening 70 in cap 50 to dispensing opening 53 and into dispensing cup 80 prior to the initiation of a treatment cycle. A highly viscous additive liquid will be slow to pass through dosage gauge 72 allowing a user to measure the amount of additive liquid using the graduated dosage levels 74 before the additive liquid passes through the liquid pass through opening 70 and dispensing opening 53 in cap 50 and into the dispensing cup 80 via the liquid passage 60.

By an example embodiment, typically, in a centrifugally actuated dispensing system, the wash additive liquid remains in the dispensing cup 80 during the wash phase of the treatment cycle selected by the user. During a spin phase of the treatment cycle prior to the rinse phase, when the agitator assembly 30 is spinning, the liquid is centrifugally forced upwardly along the interior walls and out of the dispensing cup 80 and collected in the additive dispensing reservoir 84. Once the spin phase has completed, the liquid drains from the bottom of the reservoir 84 through one or more dispensing holes 82 and into the wash bath.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims can be combined with each other in any possible combination, even if the combinations have not been expressly claimed.

What is claimed is:

1. An agitator assembly for a fabric treating appliance comprising:

a base;

a tower extending upwardly from the base and terminating in an upper end having a recess;

at least one vane located on the base;

a cap having a top and a bottom; and a scrub brush having bristles extending outwardly from the bottom of the cap;

wherein the cap is removably mounted to the tower and when the cap is mounted to the tower, the cap confronts the upper end of the tower and at least a portion of the bristles extend downward and are received in the recess in the upper end of the tower.

2. The agitator assembly of claim 1 wherein the bristles are provided only on the bottom of the cap.

3. The agitator assembly of claim 1 wherein the cap is threadably mounted to the upper end.

4. The agitator assembly of claim 1 wherein the cap defines a treating chemistry reservoir.

5. The agitator assembly of claim 4 wherein the cap has at least one dispensing opening fluidly coupling the treating chemistry reservoir to the scrub brush.

6. The agitator assembly of claim 5 wherein the cap further comprises a valve selectively opening/closing the dispensing opening.

7. The agitator assembly of claim 6 wherein the cap further comprises a valve actuator selectively actuating the valve.

8. The agitator assembly of claim 7 wherein the valve actuator comprises a button accessible from the exterior of the cap.

9. The agitator assembly of claim 1 further comprising a scrubbing surface located on the upper end.

10. The agitator assembly of claim 9 wherein the scrubbing surface is perforated.

11. The agitator assembly of claim 10 wherein the scrubbing surface comprises a mesh.

12. The agitator assembly of claim 11 further comprising a frame supporting the mesh is in a spaced relationship to the upper end.

13. The agitator assembly of claim 9 wherein the upper end comprises a liquid passage located beneath the upper end.

14. The agitator assembly of claim 9 wherein the scrubbing brush confronts the scrubbing surface when the cap is mounted to the upper end.

15. The agitator assembly of claim 1 wherein the cap comprises a pass through opening fluidly coupled to a dispensing cup.

16. An agitator assembly for a fabric treating appliance comprising:

a base;

a tower extending upwardly from the base and terminating in an upper end having a recess;

at least one vane located on the base;

a cap having a top and a bottom, the cap being removably mounted to the tower; and a scrub brush having bristles extending from only the bottom of the cap;

wherein when the cap is mounted to the tower, the bottom of the cap confronts the upper end of the tower and the scrub brush is located between the upper end and the bottom wherein at least a portion of the bristles extend downward and are received in the recess in the upper end of the tower.

17. The agitator assembly of claim 16 wherein the cap defines a treating chemistry reservoir.

18. The agitator assembly of claim 17 wherein the cap has at least one dispensing opening fluidly coupling the treating chemistry reservoir to the scrub brush.

19. The agitator assembly of claim 16 further comprising a scrubbing surface located on the upper end.

20. The agitator assembly of claim 16 wherein further comprising a dispensing cup in the upper end and the cap comprises a pass through opening fluidly coupled to the dispensing cup.

* * * * *